US008494840B2

(12) United States Patent
Muesch

(10) Patent No.: US 8,494,840 B2
(45) Date of Patent: Jul. 23, 2013

(54) RATIO OF SPEECH TO NON-SPEECH AUDIO SUCH AS FOR ELDERLY OR HEARING-IMPAIRED LISTENERS

(75) Inventor: Hannes Muesch, San Francisco, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 1015 days.

(21) Appl. No.: 12/526,733

(22) PCT Filed: Feb. 12, 2008

(86) PCT No.: PCT/US2008/001841

§ 371 (c)(1), (2), (4) Date: Aug. 11, 2009

(87) PCT Pub. No.: WO2008/100503

PCT Pub. Date: Aug. 21, 2008

(65) Prior Publication Data

US 2010/0106507 A1 Apr. 29, 2010

Related U.S. Application Data

(60) Provisional application No. 60/900,821, filed on Feb. 12, 2007.

(51) Int. Cl.
*G10L 19/00* (2006.01)

(52) U.S. Cl.
USPC ..... 704/200.1; 704/208; 704/500; 704/202; 704/233; 370/216; 370/516; 700/94

(58) Field of Classification Search
USPC ..... 704/200.1, 203, 208, 206, 207, 219, 704/500–504, 229, 233, 258, 217; 700/94; 370/216, 516
See application file for complete search history.

(56) References Cited

U.S. PATENT DOCUMENTS 5,394,473 A * 2/1995 Davidson ..... 704/200.1
5,583,962 A 12/1996 Davis et al.

(Continued)

FOREIGN PATENT DOCUMENTS

WO 99/53612 A 10/1999
WO 01/65888 A 9/2001

OTHER PUBLICATIONS

EPO Intl Searching Authority, Notification of Transmittal of the International Search Report and the Written Opinion of the International Searching Authority, or the Declaration, mailed Sep. 25, 2008.

(Continued)

*Primary Examiner* — Vijay B Chawan

(57) ABSTRACT

The invention relates to audio signal processing and speech enhancement. In accordance with one aspect, the invention combines a high-quality audio program that is a mix of speech and non-speech audio with a lower-quality copy of the speech components contained in the audio program for the purpose of generating a high-quality audio program with an increased ratio of speech to non-speech audio such as may benefit the elderly, hearing impaired or other listeners. Aspects of the invention are particularly useful for television and home theater sound, although they may be applicable to other audio and sound applications. The invention relates to methods, apparatus for performing such methods, and to software stored on a computer-readable medium for causing a computer to perform such methods.

24 Claims, 3 Drawing Sheets

U.S. PATENT DOCUMENTS

| | | | | |
|---|---|---|---|---|
| 5,596,676 | A * | 1/1997 | Swaminathan et al. | 704/208 |
| 5,632,005 | A | 5/1997 | Davis et al. | |
| 5,633,981 | A | 5/1997 | Davis | |
| 5,727,119 | A | 3/1998 | Davidson et al. | |
| 5,864,311 | A * | 1/1999 | Johnson et al. | 341/155 |
| 5,872,531 | A * | 2/1999 | Johnson et al. | 341/110 |
| 5,907,822 | A * | 5/1999 | Prieto, Jr. | 704/202 |
| 6,021,386 | A | 2/2000 | Davis et al. | |
| 6,208,618 | B1 * | 3/2001 | Kenney et al. | 370/216 |
| 6,922,669 | B2 * | 7/2005 | Schalk et al. | 704/255 |
| 7,668,713 | B2 * | 2/2010 | Zinser et al. | 704/219 |
| 8,170,882 | B2 * | 5/2012 | Davis | 704/500 |
| 8,175,888 | B2 * | 5/2012 | Ashley et al. | 704/500 |
| 2002/0116176 | A1 * | 8/2002 | Tsourikov et al. | 704/9 |
| 2003/0182104 | A1 | 9/2003 | Muesch | |
| 2006/0045139 | A1 * | 3/2006 | Black et al. | 370/516 |
| 2006/0282262 | A1 * | 12/2006 | Vos et al. | 704/219 |
| 2009/0070118 | A1 * | 3/2009 | Den Brinker et al. | 704/500 |

OTHER PUBLICATIONS

ATSC Standard A52/A: Digital Audio Compression Standard (AC-3, E-AC-3), Revision B, Adv. TV Systems Committee, Jun. 14, 2005.

ATSC Standard: Digital Television Standard (A/53), revision D, Including Amendment No. 1, Section 6.5 Hearing Impaired (HI), Jul. 27, 2005.

Bosi, M., et al., "High Quality, Low-Rate Audio Transform Coding for Transmission and Multimedia Applications", Audio Engineering Society Preprint 3365, 93rd AES Convention, Oct. 1-4, 1992.

Bosi, et al., "ISO/IEC MPEG-2 Advanced Audio Coding", Proc. of the 101st AES-Convention, J. Audio Eng. Soc., vol. 45, No. 10, Oct. 1997.

Brandenburg, K., "MP3 and AAC explained", Proc. of the AES 17th Intl Conference on High Quality Audio Coding, Florence Italy, 1999.

Davis, Mark, "The AC-3 Multichannel Coder", Audio Engineering Society Preprint 3774, 95th AES Convention, Oct. 1003.

Dolby Labaratories, "Dolby Digital Professional Encoding Guidelines", www.dolby.com/assets/pdf/tech_library/46_DDEncoding-Guidelines.pdf, May 23, 2008, pp. 5-9.

Grill et al., Intl Standard, "Information Technology—Very Low Bitrate Audio-Visual Coding", ISO/JTC 1/SC 29/WG11 ISO/IEC IS-14496 (Part 3, Audio) ISO/IEC 14496-3 Subpart 1:1998.

Intl Standard "Information technology—Generic coding of moving pictures and associated audio information—Part 7: Advanced Audio Coding (AAC)", ISO/IEC 13818-7:1997(E) 1st edition Dec. 1, 1997.

Killion, M., "New Thinking on Hearing in Noise: A Generalized Articulation Index", Seminars in Hearing, vol. 23, No. 1, 2002, pp. 57-75.

Soulodre, G. A., et al., "Subjective Evaluation of State-of-the-Art Two-Channel Audio Codecs", J. Audio Eng. Soc., vol. 46, No. 3, pp. 164-177, Mar. 1998.

Todd, C.C., "Loudness uniformity and dynamic range control for digital multichannel audio broadcasting", Broadcasting Convention, Intl Amsterdam Netherlands, Jan. 1, 1995, pp. 149.

Vernon, Steve, "Design and Implementation of AC-3 Coders", IEEE Trans. Consumer Electronics, vol. 41, No. 3, Aug. 1995.

* cited by examiner

RATIO OF SPEECH TO NON-SPEECH AUDIO SUCH AS FOR ELDERLY OR HEARING-IMPAIRED LISTENERS

TECHNICAL FIELD

The invention relates to audio signal processing and speech enhancement. In accordance with one aspect, the invention combines a high-quality audio program that is a mix of speech and non-speech audio with a lower-quality copy of the speech components contained in the audio program for the purpose of generating a high-quality audio program with an increased ratio of speech to non-speech audio such as may benefit the elderly, hearing impaired or other listeners. Aspects of the invention are particularly useful for television and home theater sound, although they may be applicable to other audio and sound applications. The invention relates to methods, apparatus for performing such methods, and to software stored on a computer-readable medium for causing a computer to perform such methods.

BACKGROUND ART

In movies or on television, dialog and narrative are often presented together with other, non-speech, sounds such as music, jingles, effects, and ambiance. In many cases the speech sounds and the non-speech sounds are recorded separately and mixed under the control of a sound engineer. When speech and non-speech sounds are mixed, the non-speech sounds may partially mask the speech, thereby rendering a fraction of the speech inaudible. As a result, listeners must comprehend the speech based on the remaining, partial information. A small amount of masking is easily tolerated by young listeners with healthy ears. However, as masking increases, comprehension becomes progressively more difficult until the speech eventually becomes unintelligible (see e.g., ANSI S3.5 1997 "Methods for Calculation of the Speech Intelligibility Index"). The sound engineer is intuitively aware of this relationship and mixes speech and background at relative levels that usually provide adequate intelligibility for the majority of viewers.

While background sounds hinder intelligibility for all viewers, the detrimental effect of background sounds is larger for seniors and persons with hearing impairment (c.f., Killion, M. 2002. "New thinking on hearing in noise: A generalized Articulation Index" in *Seminars in Hearing*, Volume 23, Number 1, pages 57 to 75, Thieme Medical Publishers, New York, N.Y.). The sound engineer, who typically has normal hearing and is younger than at least part of his audience, selects the ratio of speech to non-speech audio based on his own internal standards. Sometimes that leaves a significant portion of the audience straining to follow the dialog or narrative.

One solution known in the prior art exploits the fact that speech and non-speech audio exist separately at some point in the production chain in order to provide the viewer with two separate audio streams. One stream carries primary content audio (mainly speech) and the other carries secondary content audio (the remaining audio program, which excludes speech). The user is given control over the mixing process. Unfortunately, this scheme is impractical because it does not build on the current practice of transmitting a fully mixed audio program. Rather, it replaces the main audio program with two audio streams that are not in use today. A further disadvantage of the approach is that it requires approximately twice the bandwidth of current broadcast practice because two independent audio streams, each of broadcast quality, must be delivered to the user.

The successful audio coding standard AC-3 allows simultaneous delivery of a main audio program and other, associated audio streams. All streams are of broadcast quality. One of these associated audio streams is intended for the hearing impaired. According to the "Dolby Digital Professional Encoding Guidelines," section 5.4.4, available at http://www.dolby.com/assets/pdf/tech_library/46_DDEncoding-Guidelines.pdf, this audio stream typically contains only dialog and is added, at a fixed ratio, to the center channel of the main audio program (or to the left and right channels if the main audio is two-channel stereo), which already contains a copy of that dialog. See also *ATSC Standard: Digital Television Standard* (*A*/53), *revision D, Including Amendment No.* 1, Section 6.5 Hearing Impaired (HI). Further details of AC-3 may be found in the AC-3 citations below under the heading "Incorporation by Reference."

It is clear from the preceding discussion that at present there is a need for, but no way of increasing the ratio of speech to non-speech audio in a manner that exploits the fact that speech and non-speech audio are recorded separately while building on the current practice of transmitting a fully mixed audio program and also requiring minimal additional bandwidth. Therefore, it is the object of the present invention to provide a method for optionally increasing the ratio of speech to non-speech audio in a television broadcast that requires only a small amount of additional bandwidth, exploits the fact that speech and non-speech audio are recorded separately, and is an extension rather than a replacement of existing broadcast practice.

DISCLOSURE OF THE INVENTION

According to a first aspect of the invention for enhancing speech portions of an audio program having speech and non-speech components, the audio program having speech and non-speech components is received, the audio program having a high quality such that when reproduced in isolation the program does not have audible artifacts that listeners would deem objectionable, a copy of speech components of the audio program is received, the copy having a low quality such that when reproduced in isolation the copy has audible artifacts that listeners would deem objectionable, and the low-quality copy of speech components and the high-quality audio program are combined in such proportions that the ratio of speech to non-speech components in the resulting audio program is increased and the audible artifacts of the low-quality copy of speech components are masked by the high-quality audio program.

According to an aspect of the invention in which speech portions of an audio program having speech and non-speech components are enhanced with a copy of speech components of the audio program, the copy having a low quality such that when reproduced in isolation the copy has audible artifacts that listeners would deem objectionable, the low-quality copy of the speech components and the audio program are combined in such proportions that the ratio of speech to non-speech components in the resulting audio program is increased and the audible artifacts of the low-quality copy of speech components are masked by the audio program.

In either of the just-mentioned aspects, the proportions of combining the copy of speech components and the audio program may be such that the speech components in the resulting audio program have substantially the same dynamic characteristics as the corresponding speech components in the audio program and the non-speech components in the resulting audio program have a compressed dynamic range relative to the corresponding non-speech components in the audio program.

Alternatively, in either of the just-mentioned aspects, the proportions of combining the copy of speech components and the audio program are such that the speech components in the resulting audio program have a compressed dynamic range relative to the corresponding speech components in the audio program and the non-speech components in the resulting audio program have substantially the same dynamic characteristics as the corresponding non-speech components in the audio program.

In accordance with another aspect of the invention, enhancing speech portions of an audio program having speech and non-speech components includes receiving the audio program having speech and non-speech components, receiving a copy of speech components of the audio program, and combining the copy of speech components and the audio program in such proportions that the ratio of speech to non-speech components in the resulting audio program is increased, the speech components in the resulting audio program having substantially the same dynamic characteristics as the corresponding speech components in the audio program, and the non-speech components in the resulting audio program having a compressed dynamic range relative to the corresponding non-speech components in the audio program.

In accordance with another aspect of the invention, enhancing speech portions of an audio program having speech and non-speech components with a copy of speech components of the audio program includes combining the copy of speech components and the audio program in such proportions that the ratio of speech to non-speech components in the resulting audio program is increased, the speech components in the resulting audio program have substantially the same dynamic characteristics as the corresponding speech components in the audio program, and the non-speech components in the resulting audio program have a compressed dynamic range relative to the corresponding non-speech components in the audio program.

In accordance with yet another aspect of the invention for enhancing speech portions of an audio program having speech and non-speech components, the audio program having speech and non-speech components is received, a copy of speech components of the audio program is received, and the copy of speech components and the audio program are combined in such proportions that the ratio of speech to non-speech components in the resulting audio program is increased, the speech components in the resulting audio program have a compressed dynamic range relative to the corresponding speech components in the audio program, and the non-speech components in the resulting audio program have substantially the same dynamic characteristics as the corresponding non-speech components in the audio program.

In accordance with a further aspect of the invention for enhancing speech portions of an audio program having speech and non-speech components with a copy of speech components of the audio program, the copy of speech components and the audio program are combined in such proportions that the ratio of speech to non-speech components in the resulting audio program is increased, the speech components in the resulting audio program have a compressed dynamic range relative to the corresponding speech components in the audio program, and the non-speech components in the resulting audio program have substantially the same dynamic range characteristics as the corresponding non-speech components in the audio program.

Although the examples of implementing the present invention are in the context of television or home theater sound, it will be understood by those of ordinary skill in the art that the invention may be applied in other audio and sound applications.

If television or home theater viewers have access to both the main audio program and a separate audio stream that contains only the speech components, any ratio of speech to non-speech audio can be achieved by suitably scaling and mixing the two components. For example, if it is desired to suppress the non-speech audio completely so that only speech is heard, only the stream containing the speech sound is played. At the other extreme, if it is desired to suppress the speech completely so that only the non-speech audio is heard, the speech audio is simply subtracted from the main audio program. Between the extremes, any intermediate ratio of speech to non-speech audio may be achieved.

To make an auxiliary speech channel commercially viable it must not be allowed to increase the bandwidth allocated to the main audio program by more than a small fraction. To satisfy this constraint, the auxiliary speech must be encoded with a coder that reduces the data rate drastically. Such data rate reduction comes at the expense of distorting the speech signal. Speech distorted by low-bitrate coding can be described as the sum of the original speech and a distortion component (coding noise). When the distortion becomes audible it degrades the perceived sound quality of the speech. Although the coding noise can have a severe impact on the sound quality of a signal, its level is typically much lower than that of the signal being coded.

In practice, the main audio program is of "broadcast quality" and the coding noise associated with it is nearly imperceptible. In other words, when reproduced in isolation the program does not have audible artifacts that listeners would deem objectionable. In accordance with aspects of the present invention, the auxiliary speech, on the other hand, if listened to in isolation, may have audible artifacts that listeners would deem objectionable because its data rate is restricted severely. If heard in isolation, the quality of the auxiliary speech is not adequate for broadcast applications.

Whether or not the coding noise that is associated with the auxiliary speech is audible after mixing with the main audio program depends on whether the main audio program masks the coding noise. Masking is likely to occur when the main program contains strong non-speech audio in addition to the speech audio. In contrast, the coding noise is unlikely to be masked when the main program is dominated by speech and the non-speech audio is weak or absent. These relationships are advantageous when viewed from the perspective of using the auxiliary speech to increase the relative level of the speech in the main audio program. Program sections that are most likely to benefit from adding auxiliary speech (i.e., sections with strong non-speech audio) are also most likely to mask the coding noise. Conversely, program sections that are most vulnerable to being degraded by coding noise (e.g., speech in the absence of background sounds) are also least likely to require enhanced dialog.

These observations suggest that, if a signal-adaptive mixing process is employed, it is possible to combine auxiliary speech that is audibly distorted with a high-quality main audio program to create an audio program with an increased ratio of speech to non-speech audio that is free of audible distortions. The adaptive mixer preferably limits the relative mixing levels so that the coding noise remains below the masking threshold caused by the main audio program. This is possible by adding low-quality auxiliary speech only to those sections of the audio program that have a low ratio of speech to non-speech audio initially. Exemplary implementations of this principle are described below.

BEST MODE FOR CARRYING OUT THE INVENTION

Figure 1:
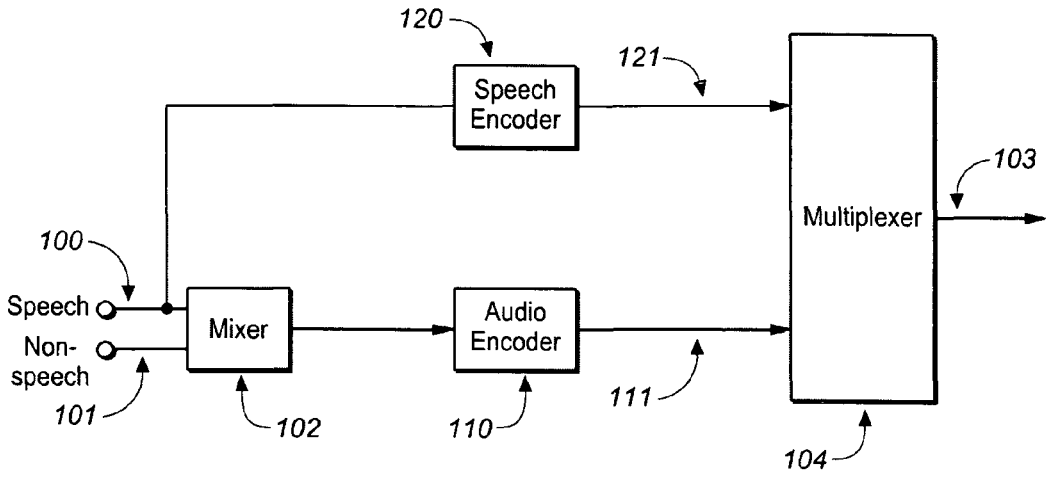
FIG. 1 is an example of an encoder or encoding function embodying aspects of the invention.
Figure 2:
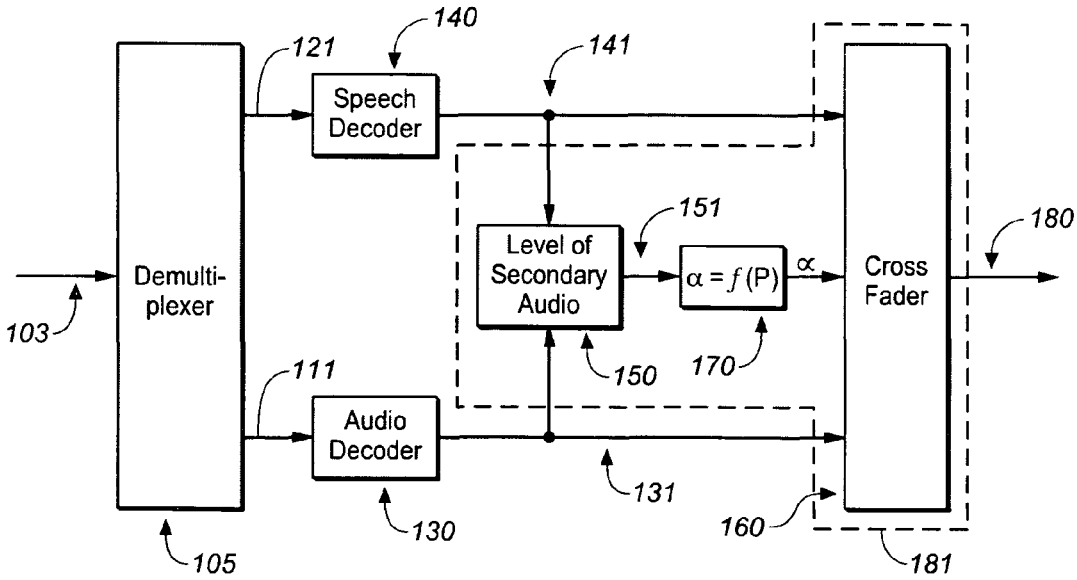
FIG. 2 is an example of a decoder or decoding function embodying aspects of the invention including an adaptive crossfader.
Figure 5:
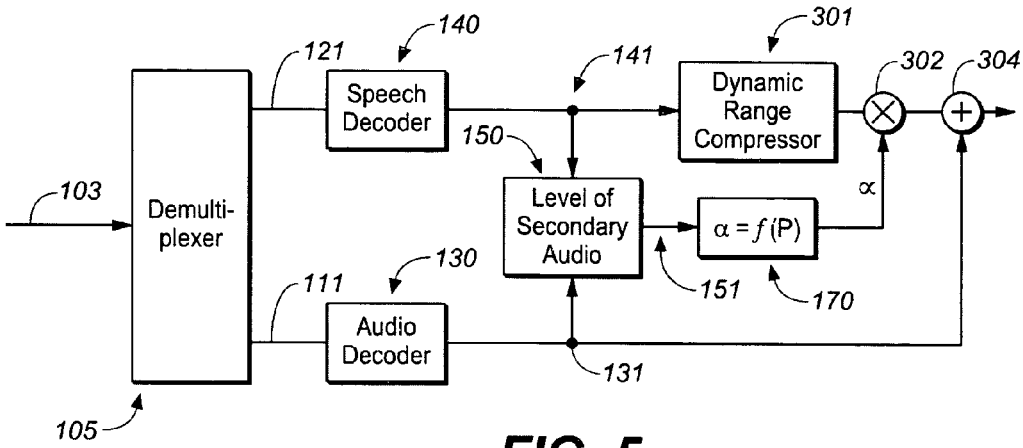
FIG. 5 is an example of a decoder or decoding function embodying aspects of the invention including dynamic range compression of certain non-speech components.

FIGS. 1 and 2 show, respectively, encoding and decoding arrangements that embody aspects of the present invention. FIG. 5 shows an alternative decoding arrangement embodying aspects of the present invention. Referring to the FIG. 1 example of an encoder or encoding function embodying aspects of the invention, two components of a television audio program, one containing predominantly speech 100 and one containing predominantly non-speech 101, are mixed in a mixing console or mixing function ("Mixer") 102 as part of an audio program production processor or process. The resulting audio program, containing both speech and non-speech signals, is encoded with a high-bitrate, high-quality audio encoder or encoding function ("Audio Encoder") 110 such as AC-3 or AAC. Further details of AAC may be found in the AAC citations below under the heading "Incorporation by Reference." The program component containing predominantly speech 100 is simultaneously encoded with an encoder or encoding function ("Speech Encoder") 120 that generates coded audio at a bitrate that is substantially lower than the bitrate generated by the audio encoder 110. The audio quality achieved by Speech Encoder 120 is substantially worse than the audio quality achieved with the Audio Encoder 110. The Speech Encoder 120 may be optimized for encoding speech but should also attempt to preserve the phase of the signal. Coders fulfilling such criteria are known per se. One example is the class of Code Excited Linear Prediction (CELP) coders. CELP coders, like other so-called "hybrid coders," model the speech signal with the source-filter model of speech production to achieve a high coding gain, but also attempt to preserve the waveform to be coded, thereby limiting phase distortions.

In an experimental implementation of aspects of the invention, a speech encoder implemented as a CELP vocoder running at 8 Kbit/sec was found to be suitable and to provide the perceptual equivalent of about a 10-dB increase in speech to non-speech audio level.

If the coding delays of the two encoders differ, at least one of the signals should be time shifted to maintain time alignment between the signals (not shown). The outputs of both the high-quality Audio Encoder 110 and the low-quality Speech Encoder 120 may subsequently be combined into a single bitstream by a multiplexer or multiplexing function ("Multiplexer") 104 and packed into a bitstream 103 suitable for broadcasting or storage.

Referring now to the FIG. 2 example of a decoder or decoding function embodying aspects of the invention, the bitstream 103 is received. For example, from a broadcast interface or retrieved from a storage medium and applied to a demultiplexer or demultiplexing function ("Demultiplexer") 105 where it is unpacked and demultiplexed to yield the coded main audio program 111 and the coded speech signal 121. The coded main audio program is decoded with an audio decoder or decoding function ("Audio Decoder") 130 to produce a decoded main audio signal 131 and the coded speech signal is decoded with a speech decoder or decoding function ("Speech Decoder") 140 to produce a decoded speech signal 141. In this example, both signals are combined in a crossfader or crossfading function ("Crossfader") 160 to yield an output signal 180. The signals are also passed to a device or function ("Level of Non-Speech Audio") 150 that measures the power level P of the non-speech audio 151 by, for example, subtracting the power of the decoded speech signal from the power of the decoded main audio program. The crossfade is controlled by a weighting or scaling factor $\alpha$. Weighting factor $\alpha$, in turn, is derived from the power level P of the non-speech audio 151 through a Transformation 170. In other words, $\alpha$ is a function of P (i.e., $\alpha=f(P)$). The result is a signal-adaptive mixer. This transformation or function is typically such that the value of $\alpha$, which is constrained to be non-negative, increases with increasing power level P. The scaling factor $\alpha$ should be limited not to exceed a maximal value $\alpha_{max}$, where $\alpha_{max}<1$ but in any event is not so large that the coding noise does become unmasked, as is explained further below. The Level of Non-Speech Audio 150, Transformation 170, and Crossfader 160 constitute a signal-adaptive crossfader or crossfading function ("Signal-Adaptive Crossfader") 181, as is explained further below.

Figure 3:
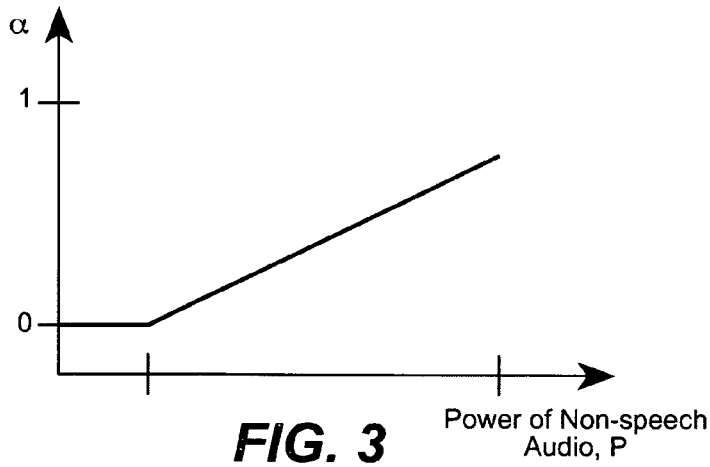
FIG. 3 is an example of a function $\alpha=f(P)$ that may be employed in the example of FIG. 2.
Figure 4:
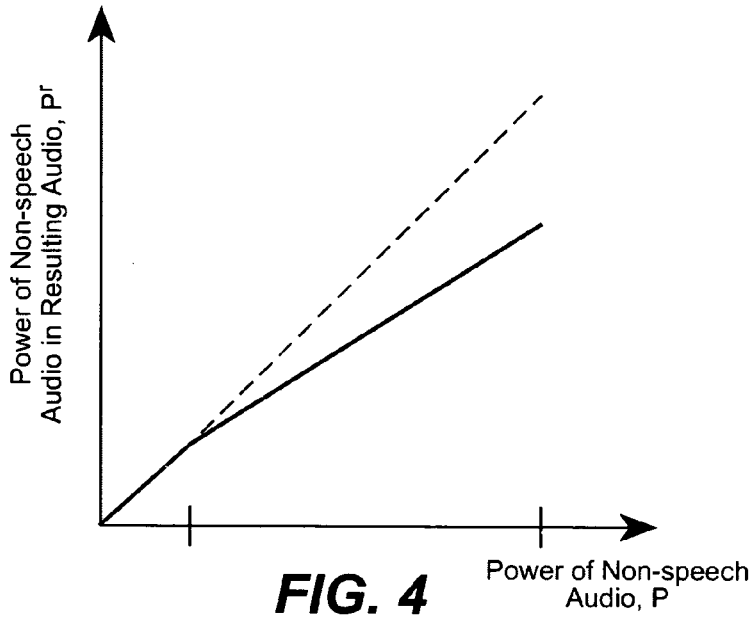
FIG. 4 is a plot of the power of the non-speech audio P' in the resulting audio program versus the power of the non-speech audio P in the resulting audio program in the example of FIG. 2 when the function $\alpha=f(P)$ has a characteristic as shown in FIG. 3.

The Signal-Adaptive Crossfader 181 scales the decoded auxiliary speech by $\alpha$ and the decoded main audio program by $(1-\alpha)$ prior to additively combining them in the Crossfader 160. The symmetry in the scaling causes the level and dynamic characteristics of the speech components in the resulting signal to be independent of the scaling factor $\alpha$—the scaling does not affect the level of the speech components in the resulting signal nor does it impose any dynamic range compression or other modifications to the dynamic range of the speech components. The level of the non-speech audio in the resulting signal, in contrast, is affected by the scaling. Specifically, because the value of $\alpha$ increases with increasing power level P of the non-speech audio, the scaling tends to counteract any change of that level, effectively compressing the dynamic range of the non-speech audio signal. The form of the dynamic range compression is determined by the Transformation 170. For example, if the function $\alpha=f(P)$ takes the form as shown in FIG. 3, then, as shown in FIG. 4, a plot of the power of the non-speech audio P' in the resulting audio program versus the power of the non-speech audio P illustrates a compression characteristic—above a minimum non-speech power level, the resulting non-speech power rises more slowly than the non-speech power level.

The function of the Adaptive Crossfader 181 may be summarized as follows: when the level of the non-speech audio components is very low, the scaling factor $\alpha$ is zero or very small and the Adaptive Crossfader outputs a signal that is identical or nearly identical to the decoded main audio program. When the level of the non-speech audio increases, the value of α increases also. This leads to a larger contribution of the decoded auxiliary speech to the final audio program 180 and to a larger suppression of the decoded main audio program, including its non-speech audio components. The increased contribution of the auxiliary speech to the enhanced signal is balanced by the decreased contribution of speech in the main audio program. As a result, the level of the speech in the enhanced signal remains unaffected by the adaptive cross-fading operation—the level of the speech in the enhanced signal is substantially the same level as the level of the decoded speech audio signal 141 and the dynamic range of the non-speech audio components is reduced. This is a desirable result inasmuch as there is no unwanted modulation of the speech signal.

For the speech level to remain unchanged, the amount of auxiliary speech added to the dynamic-range-compressed main audio signal should be a function of the amount of compression applied to the main audio signal. The added auxiliary speech compensates for the level reduction resulting from the compression. This automatically results from applying the scale factor α to the auxiliary speech signal and the complementary scale factor (1−α) to the main audio when α is a function of the dynamic range compression applied to the main audio. The effect on the main audio is similar to that provided by the "night mode" in AC-3 in which as the main audio level input increases the output is turned down in accordance with a compression characteristic.

To ensure that the coding noise does not become unmasked, the adaptive cross fader 160 should prevent the suppression of the main audio program beyond a critical value. This may be achieved by limiting α to be less than or equal to $\alpha_{max}$. Although satisfactory performance may be achieved when $\alpha_{max}$ is a fixed value, better performance is possible if $\alpha_{max}$ is derived with a psychoacoustic masking model that compares the spectrum of the coding noise associated with the low-quality speech signal 141 to the predicted auditory masking threshold caused by the main audio program signal 131.

Figure 6:
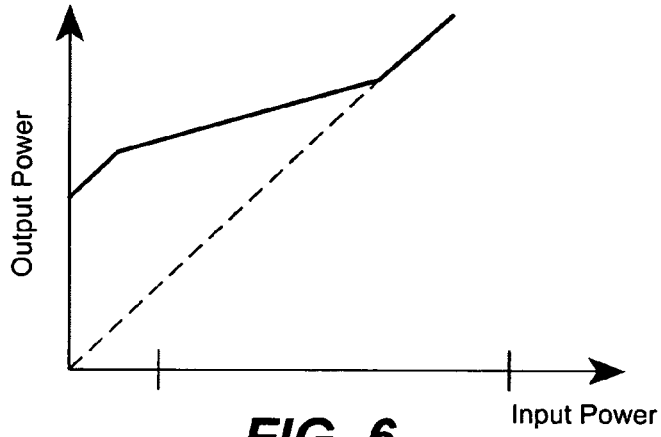
FIG. 6 is a plot of a compressor's input power versus output power characteristic, which is useful in understanding FIG. 5.

Referring to the FIG. 5 alternative example of a decoder or decoding function embodying aspects of the invention, the bitstream 103 is received, for example, from a broadcast interface or retrieved from a storage medium and applied to a demultiplexer or demultiplexing function ("Demultiplexer") 105 to yield the coded main audio program 111 and the coded speech signal 121. The coded main audio program is decoded with an audio decoder or decoding function ("Audio Decoder") 130 to produce a decoded main audio signal 131 and the coded speech signal is decoded with a speech decoder or decoding function ("Speech Decoder") 140 to produce a decoded speech signal 141. Signals 131 and 141 are passed to a device or function ("Level of Non-Speech Audio") 150 that measures the power level P of the non-speech audio 151 by, for example, subtracting the power of the decoded speech signal from the power of the decoded main audio program. To this point in its description, the example of FIG. 5 is the same as the example of FIG. 2. However, the remaining portion of the FIG. 5 decoder example is different. In the FIG. 5 example, the decoded speech signal 141 is subjected to a dynamic range compressor or compression function ("Dynamic Range Compressor") 301. Compressor 301, an example of an input/output function of which is illustrated in FIG. 6, passes the high-level sections of the speech signal unmodified but applies increasingly more gain as the level of the speech signal applied to Compressor 301 decreases. Following compression, the decoded speech copy is scaled by α in a multiplier (or scalar) or multiplying (or scaling) function shown with multiplier symbol 302 and added to the decoded main audio program in an additive combiner or combining function shown with plus symbol 304. The order of Compressor 301 and multiplier 302 may be reversed.

The function of the FIG. 5 example may be summarized as follows: When the level of the non-speech audio components is very low, the scaling factor α is zero or very small and the amount of speech added to the main audio program is zero or negligible. Therefore, the generated signal is identical or nearly identical to the decoded main audio program. When the level of the non-speech audio components increase, the value of α increases also. This leads to a larger contribution of the compressed speech to the final audio program, resulting in an increased ratio of speech to non-speech components in the final audio program. The dynamic range compression of the auxiliary speech allows for large increases of the speech level when the speech level is low while causing only small increases in speech level when the speech level is high. This is an important property because it ensures that the peak loudness of the speech does not increase substantially while also allowing substantial loudness increases during soft speech sections. Thus, the ratio of speech to non-speech components in the resulting audio program is increased, the speech components in the resulting audio program have a compressed dynamic range relative to the corresponding speech components in the audio program, and the non-speech components in the resulting audio program have substantially the same dynamic range characteristics as the corresponding non-speech components in the audio program.

The decoding examples of FIGS. 2 and 5 share the property that they increase the ratio of speech to non-speech, thus making speech more intelligible. In the FIG. 2 example, the speech components' dynamic characteristics are, in principle, not altered, whereas the non-speech components' dynamic characteristics are altered (their dynamic range is compressed). In the FIG. 5 example, the opposite occurs—the speech components' dynamic characteristics are altered (their dynamic range is compressed), whereas the non-speech dynamic characteristics are, in principle, not altered.

In the FIG. 5 example, the decoded speech copy signal is subjected to dynamic range compression and scaling by the scaling factor α (in either order). The following explanation may be useful in understanding their combined effect. Consider the case where there is a high level of non-speech audio so that α is large (for example, let α=1). Also consider the level of the speech coming from Compressor 301:

(a) when the speech level is high (speech peaks) the compressor provides no gain and passes the signal without modification (as shown by the input/output function in FIG. 6, at high levels the response characteristic coincides with the dashed diagonal line which marks the relation where the output equals the input.) Therefore, during speech peaks, the speech level at the output of the compressor is the same as the as the level of the speech peaks in the main audio. Upon adding the decoded speech copy audio to the main audio, the level of the summed speech peaks is 6 dB higher than the original speech peaks. The level of the non-speech audio did not change, so the ratio of speech to non-speech audio increases by 6 dB; and (b) when the speech level is low (e.g., a soft consonant) the compressor provides a significant amount of gain (the input/output curve is well above the dashed diagonal line of FIG. 6). For the purpose of discussion, assume the compressor applies 20 dB of gain. Upon adding the output of the compressor with the main audio, the ratio of speech to non-speech audio is increased by about 20 dB because the speech is mostly speech from the decoded speech copy signal. When the level of the non-speech audio decreases, alpha decreases and progressively less of the decoded speech copy is added.

Although the Compressor 301 gain is not critical, a gain of about 15 to 20 dB has been found to be acceptable.

The purpose of the Compressor 301 may be better understood by considering the operation of the FIG. 5 example without it. In that case, the increase in the ratio of speech to non-speech audio is directly proportional to $\alpha$. If $\alpha$ were limited not to exceed 1, then the maximum amount of speech to non-speech improvement would be 6 dB, a reasonable improvement, but less than may be desired. If $\alpha$ is allowed to become larger than 1, then the speech to non-speech improvement can become larger too, but, assuming that the speech level is higher than the level of the non-speech audio, the overall level would also increase and potentially create problems such as overload or excessive loudness.

Problems such as overload or excessive loudness may by overcome by including Compressor 301 and adding compressed speech to the main audio. Assume again that $\alpha=1$. When the instantaneous speech level is high, the compressor has no effect (0 dB gain) and the speech level of the summed signal increases by a comparatively small amount (6 dB). This is identical to the case in which there is no compressor 301. But when the instantaneous speech level is low (say 30 dB below the peak level), the compressor applies a high gain (say 15 dB). When added to the main audio the instantaneous speech level in the resultant audio is practically dominated by the compressed auxiliary audio, i.e., the instantaneous speech level is boosted by about 15 dB. Compare this to the 6 dB boost of the speech peaks. So even when $\alpha$ is constant (e.g., because the power level, P, of the non-speech audio components is constant), there is a time-varying speech to non-speech improvement that is largest in the speech troughs and smallest at the speech peaks.

As the level of the non-speech audio decreases and a decreases, the speech peaks in the summed audio remain nearly unchanged. This is because the level of the decoded speech copy signal is substantially lower than the level of the speech in the main audio (due to the attenuation imposed by $\alpha<1$) and adding the two together does not significantly affect the level of the resulting speech signal. The situation is different for low-level speech portions. They receive gain from the compressor and attenuation due to $\alpha$. The end result is levels of the auxiliary speech that are comparable to (or even larger than, depending on the compressor settings) the level of the speech in the main audio. When added together they do affect (increase) the level of the speech components in the summed signal.

The end result is that the level of the speech peaks is more "stable" (i.e., changes never more than 6 dB) than the speech level in the speech troughs. The speech to non-speech ratio is increased most where increases are needed most and the level of the speech peaks changes comparatively little.

Figure 7:
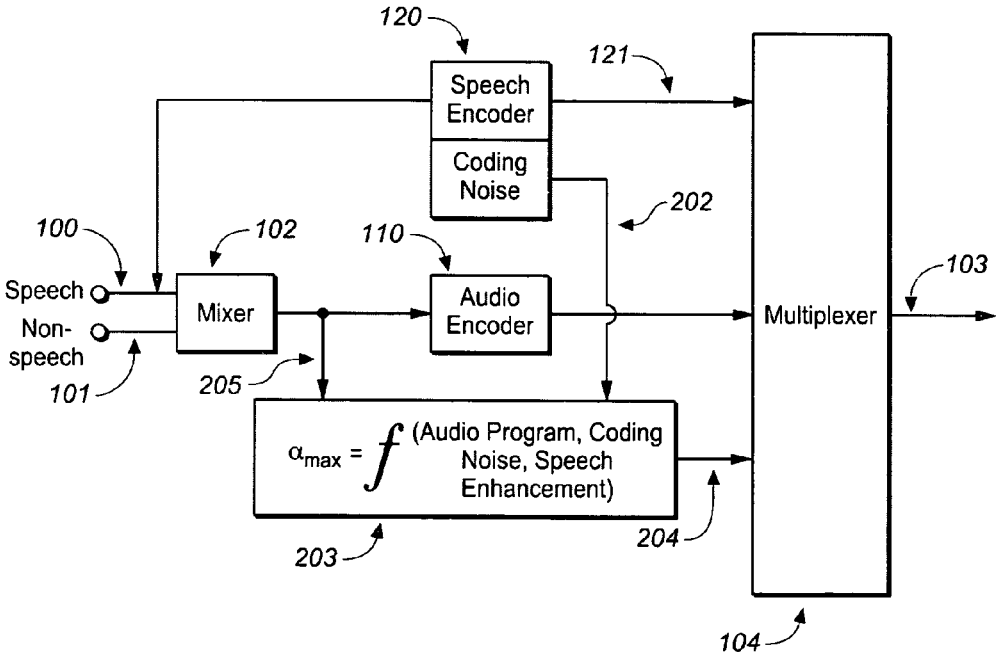
FIG. 7 is an example of an encoder or encoding function embodying aspects of the invention including, optionally, the generation of one or more parameters useful in decoding.

Because the psychoacoustic model is computationally expensive, it may be desirable from a cost standpoint to derive the largest permissible value of $\alpha$ at the encoding rather than the decoding side and to transmit that value or components from which that value may be easily calculated as a parameter or plurality of parameters. For example that value may be transmitted as a series of $\alpha_{max}$ values to the decoding side. An example of such an arrangement is shown in FIG. 7. A key element of the arrangement is a function or device ("$\alpha_{max}$=f (Audio Program, Coding Noise, Speech Enhancement)") 203 that derives the largest value of $\alpha$ that satisfies the constraint that the predicted auditory masking threshold caused by the audio signal components of the resulting audio output of the decoder exceeds by a given safety margin the coding noise of the auxiliary speech components in the resulting audio output of the decoder. To this end the function or device 203 receives as input the main audio program 205 and the coding noise 202 that is associated with the coding of the auxiliary speech 100. The representation of the coding noise may be obtained in several ways. For example, the coded speech 121 may be decoded again and subtracted from the input speech 100 (not shown). Many coders, including hybrid coders such as CELP coders, operate on the "analysis-by-synthesis" principle. Coders operating on the analysis-by-synthesis principle execute the step of subtracting the decoded speech from the original speech to obtain a measure of the coding noise as part of their normal operation. If such a coder is used, a representation of the coding noise 202 is directly available without the need for additional computations.

The function or device 203 also has knowledge of the processes performed by the decoder and the details of its operation depend on the decoder configuration in which $\alpha_{max}$ is used. Suitable decoder configurations may be in the form of the FIG. 2 example or the FIG. 5 example.

If the stream of $\alpha_{max}$ values generated by the function or device 203 is intended to be used by a decoder such as illustrated in FIG. 2, function or device 203 may perform the following operations:

a) The main audio program 205 is scaled by $1-\alpha_i$, where $\alpha_i$ is an initial guess of the desired result $\alpha_{max}$.

b) The auditory masking threshold that is caused by the scaled main audio program is predicted with an auditory masking model. Auditor masking models are well known to those of ordinary skill in the art.

c) The coding noise 202 that is associated with the auxiliary speech is scaled by $\alpha_i$.

d) The scaled coding noise is compared with the predicted auditory masking threshold. If the predicted auditory masking threshold exceeds the scaled coding noise by more than a desired safety margin, the value of $\alpha_i$ is increased and steps (a) through (d) are repeated. Conversely, if the initial guess of $\alpha_i$ resulted in a predicted auditory masking threshold that is less than the scaled coding noise plus the safety margin, the value of $\alpha_i$ is decreased. The iteration continues until the desired value of is $\alpha_{max}$ found.

If the stream of $\alpha_{max}$ values generated by the function or device 203 is intended to be used by a decoder such as illustrated in FIG. 5, function or device 203 may perform the following operations:

a) The coding noise 202 that is associated with the auxiliary speech is scaled by a gain equal to the gain applied by the compressor 301 of FIG. 5 and by the scale factor $\alpha_i$, where $\alpha_i$ is an initial guess of the desired result $\alpha_{max}$.

b) The auditory masking threshold that is caused by the main audio program is predicted with an auditory masking model. If the audio encoder 110 incorporates an auditory masking model, the predictions of that model may be used, resulting in significant savings of computational cost.

c) The scaled coding noise is compared with the predicted auditory masking threshold. If the predicted auditory masking threshold exceeds the scaled coding noise by more than a desired safety margin, the value of $\alpha_i$ is increased and steps (a) through (c) are repeated. Conversely, if the initial guess of $\alpha_i$ resulted in a predicted auditory masking threshold that is less than the scaled coding noise plus the safety margin, the value of $\alpha_i$ is reduced. The iteration continues until the desired value of is $\alpha_{max}$ found.

The value of $\alpha_{max}$ should be updated at a rate high enough to reflect changes in the predicted masking threshold and in the coding noise 202 adequately. Finally, the coded auxiliary speech 121, the coded main audio program 111, and the stream of $\alpha_{max}$ values 204 may subsequently be combined into a single bitstream by a multiplexer or multiplexing function ("Multiplexer") 104 and packed into a single data bitstream 103 suitable for broadcasting or storage. Those of ordinary skill in the art will understand that the details of multiplexing, demultiplexing, and the packing and unpacking of a bitstream in the various example embodiments are not critical to the invention.

Aspects of the present invention include modifications and extensions of the examples set forth above. For example, the speech signal and the main signal may each be split into corresponding frequency subbands in which the above-described processing is applied in one or more of such subbands and the resulting subband signals are recombined, as in a decoder or decoding process, to produce an output signal.

Aspects of the present invention may also allow a user to control the degree of dialog enhancement. This may be achieved by scaling the scaling factor $\alpha$ with an additional user-controllable scale factor $\beta$, to obtain a modified scaling factor $\alpha'$, i.e., $\alpha'=\beta*\alpha$, where $0\leqq\beta\leqq1$. If $\beta$ is selected to be zero, the unmodified main audio program is heard always. If $\beta$ is selected to be 1, the maximum amount of dialog enhancement is applied. Because $\alpha_{max}$ ensures that the coding noise is never unmasked, but also because the user can only reduce the degree of dialog enhancement relative to the maximal degree of enhancement, the adjustment does not carry the risk of making coding distortions audible.

In the embodiments just described, the dialog enhancement is performed on the decoded audio signals. This is not an inherent limitation of the invention. In some situations, for example when the audio coder and the speech coder employ the same coding principles, at least some of the operations may be performed in the coded domain (i.e., before full or partial decoding).

INCORPORATION BY REFERENCE

The following patents, patent applications and publications are hereby incorporated by reference, each in their entirety.

AC-3

*ATSC Standard A52/A: Digital Audio Compression Standard* (*AC*-3, *E-AC*-3), *Revision B*, Advanced Television Systems Committee, 14 Jun. 2005. The A/52B document is available on the World Wide Web at http://www.atsc.org/standards.html.

"Design and Implementation of AC-3 Coders," by Steve Vernon, *IEEE Trans. Consumer Electronics*, Vol. 41, No. 3, August 1995.

"The AC-3 Multichannel Coder" by Mark Davis, Audio Engineering Society Preprint 3774, 95th AES Convention, October 1993.

"High Quality, Low-Rate Audio Transform Coding for Transmission and Multimedia Applications," by Bosi et al, Audio Engineering Society Preprint 3365, 93rd AES Convention, October, 1992.

U.S. Pat. Nos. 5,583,962; 5,632,005; 5,633,981; 5,727,119; and 6,021,386.

AAC

ISO/IEC JTC1/SC29, "Information technology—very low bitrate audio-visual coding," ISO/IEC IS-14496 (Part 3, Audio), 1996

1) ISO/IEC 13818-7. "MPEG-2 advanced audio coding, AAC". International Standard, 1997;

M. Bosi, K. Brandenburg, S. Quackenbush, L. Fielder, K. Akagiri, H. Fuchs, M. Dietz, J. Herre, G. Davidson, and Y. Oikawa: "ISO/IEC MPEG-2 Advanced Audio Coding". *Proc. of the* 101*st AES-Convention,* 1996;

M. Bosi, K. Brandenburg, S. Quackenbush, L. Fielder, K. Akagiri, H. Fuchs, M. Dietz, J. Herre, G. Davidson, Y. Oikawa: "ISO/IEC MPEG-2 Advanced Audio Coding", *Journal of the AES*, Vol. 45, No. 10, October 1997, pp. 789-814;

Karlheinz Brandenburg: "MP3 and AAC explained". *Proc. of the AES* 17*th International Conference on High Quality Audio Coding*, Florence, Italy, 1999; and G. A. Soulodre et al.: "Subjective Evaluation of State-of-the-Art Two-Channel Audio Codecs" *J. Audio Eng. Soc.*, Vol. 46, No. 3, pp 164-177, March 1998.

Implementation

The invention may be implemented in hardware or software, or a combination of both (e.g., programmable logic arrays). Unless otherwise specified, the algorithms included as part of the invention are not inherently related to any particular computer or other apparatus. In particular, various general-purpose machines may be used with programs written in accordance with the teachings herein, or it may be more convenient to construct more specialized apparatus (e.g., integrated circuits) to perform the required method steps. Thus, the invention may be implemented in one or more computer programs executing on one or more programmable computer systems each comprising at least one processor, at least one data storage system (including volatile and non-volatile memory and/or storage elements), at least one input device or port, and at least one output device or port. Program code is applied to input data to perform the functions described herein and generate output information. The output information is applied to one or more output devices, in known fashion.

Each such program may be implemented in any desired computer language (including machine, assembly, or high level procedural, logical, or object oriented programming languages) to communicate with a computer system. In any case, the language may be a compiled or interpreted language.

Each such computer program is preferably stored on or downloaded to a storage media or device (e.g., solid state memory or media, or magnetic or optical media) readable by a general or special purpose programmable computer, for configuring and operating the computer when the storage media or device is read by the computer system to perform the procedures described herein. The inventive system may also be considered to be implemented as a computer-readable storage medium, configured with a computer program, where the storage medium so configured causes a computer system to operate in a specific and predefined manner to perform the functions described herein.

A number of embodiments of the invention have been described. Nevertheless, it will be understood that various modifications may be made without departing from the spirit and scope of the invention. For example, some of the steps described herein may be order independent, and thus can be performed in an order different from that described.

I claim:

1. A method for enhancing speech portions of an audio program having speech and non-speech components, comprising:

receiving the audio program having speech and non-speech components, wherein the audio program when reproduced in isolation does not have audible artifacts that listeners would deem objectionable, receiving a copy of speech components of the audio program, wherein the copy when reproduced in isolation has audible artifacts that listeners would deem objectionable, and combining the copy of speech components and the audio program, wherein the ratio of speech to non-speech components in the audio program is increased and the audible artifacts of the copy of speech components are masked by the audio program.

2. A method according to claim 1 wherein the combination of the copy of speech components and the audio program has substantially the same dynamic characteristics as the corresponding speech components in the audio program and the non-speech components in the audio program has a compressed dynamic range relative to the corresponding non-speech components in the audio program.

3. A method according to claim 2 wherein the level of speech components in the resulting audio program is substantially the same as the level of the corresponding speech components in the audio program.

4. A method according to claim 3 wherein the level of non-speech components in the resulting audio program increases more slowly than the level of non-speech components in the audio program increases.

5. A method according to claim 1 wherein the combining is in accordance with complementary scale factors applied, respectively, to the copy of speech components and to the audio program.

6. A method according to claim 1 wherein the combining is an additive combination of the copy of speech components and the audio program in which the copy of speech components is scaled with a scale factor $\alpha$ and the audio program is scaled with the complementary scale factor $(1-\alpha)$, a having a range of 0 to 1.

7. A method according to claim 6 wherein $\alpha$ is a function of the level of non-speech components of the audio program.

8. A method according to claim 7 wherein $\alpha$ has a fixed maximum value $\alpha max$.

9. A method according to claim 7 wherein $\alpha$ has a dynamic maximum value $\alpha max$.

10. A method according to claim 9 wherein the value $\alpha max$ is based on a prediction of auditory masking caused by the main audio program.

11. A method according to claim 10 further comprising receiving $\alpha max$.

12. A method according to claim 6 wherein $\alpha$ has a fixed maximum value $\alpha max$.

13. A method according to claim 6 wherein $\alpha$ has a dynamic maximum value $\alpha max$.

14. A method according to claim 13 further comprising receiving $\alpha max$.

15. A method according to claim 13 wherein the value $\alpha max$ is based on a prediction of auditory masking caused by the main audio program.

16. A method according to claim 1 wherein the ratio of the combination of the copy of speech components and the audio program is such that the speech components in the combined audio program has a compressed dynamic range relative to the corresponding speech components in the audio program and the non-speech components in the combined audio program has substantially the same dynamic characteristics as the corresponding non-speech components in the audio program.

17. A method for assembling audio information for use in enhancing speech portions of an audio program having speech and non-speech components, comprising obtaining an audio program having speech and non-speech components, encoding the audio program, wherein when decoded and reproduced in isolation the program does not have audible artifacts that listeners would deem objectionable, obtaining a copy of speech components of the audio program, encoding the copy, wherein when reproduced in isolation the copy has audible artifacts that listeners would deem objectionable, and transmitting or storing the encoded audio program and the encoded copy of speech components of the audio program.

18. A method according to claim 17 further comprising multiplexing the audio program and the copy of speech components of the audio program before transmitting or storing them.

19. A method for assembling audio information for use in enhancing speech portions of an audio program having speech and non-speech components, comprising obtaining an audio program having speech and non-speech components, encoding the audio program, wherein when decoded and reproduced in isolation the program does not have audible artifacts that listeners would deem objectionable, deriving a prediction of the auditory masking threshold of the encoded audio program, obtaining a copy of speech components of the audio program, encoding the copy, wherein when reproduced in isolation the copy has audible artifacts that listeners would deem objectionable, deriving a measure of the coding noise of the encoded copy, and transmitting or storing the encoded audio program, the prediction of its auditory masking threshold, the encoded copy of speech components of the audio program and the measure of its coding noise.

20. A method according to claim 19 further comprising multiplexing the audio program, the prediction of its auditory masking threshold, the copy of speech components of the audio program, and the measure of its coding noise before transmitting or storing them.

21. A method for assembling audio information for use in enhancing speech portions of an audio program having speech and non-speech components, comprising obtaining an audio program having speech and non-speech components, encoding the audio program, wherein when decoded and reproduced in isolation the program does not have audible artifacts that listeners would deem objectionable, deriving a prediction of the auditory masking threshold of the encoded audio program, obtaining a copy of speech components of the audio program, encoding the copy, wherein when reproduced in isolation the copy has audible artifacts that listeners would deem objectionable, deriving a measure of the coding noise of the encoded copy, deriving a parameter based on a function of the prediction of the auditory masking threshold and the measure of the coding noise, and transmitting or storing the encoded audio program, the encoded copy of speech components of the audio program and the parameter.

22. A method according to claim 21 further comprising multiplexing the audio program, the copy of speech components of the audio program, and the parameter before transmitting or storing them.

23. Apparatus adapted to perform the methods of any one of claims 1, 17, 19 and 21.

24. A non-transitory computer-readable medium encoded with a computer program for causing a computer to perform the methods of any one of claims 1, 17, 19 and 21.

* * * * *